US010978036B2

(12) United States Patent
Kim et al.

(10) Patent No.: US 10,978,036 B2
(45) Date of Patent: Apr. 13, 2021

(54) SOUND ABSORBING CELL AND SOUND ABSORBING STRUCTURE HAVING THE SAME

(71) Applicant: KOREA INSTITUTE OF MACHINERY & MATERIALS, Daejeon (KR)

(72) Inventors: Hyun-Sil Kim, Daejeon (KR); Pyung-Sik Ma, Daejeon (KR); Yun-Ho Seo, Daejeon (KR); Seong-Hyun Lee, Daejeon (KR); Sang Ryul Kim, Daejeon (KR); Bong-Ki Kim, Daejeon (KR); Jae Seung Kim, Daejeon (KR)

(73) Assignee: KOREA INSTITUTE OF MACHINERY & MATERIALS, Daejeon (KR)

( * ) Notice: Subject to any disclaimer, the term of this patent is extended or adjusted under 35 U.S.C. 154(b) by 447 days.

(21) Appl. No.: 15/901,079

(22) Filed: Feb. 21, 2018

(65) Prior Publication Data

US 2019/0080676 A1 Mar. 14, 2019

(30) Foreign Application Priority Data

Sep. 13, 2017 (KR) ..... 10-2017-0117250

(51) Int. Cl.
*G10K 11/162* (2006.01)
*E04B 1/86* (2006.01)
(Continued)

(52) U.S. Cl.
CPC ..... *G10K 11/162* (2013.01); *E04B 1/86* (2013.01); *G10K 11/168* (2013.01);
(Continued)

(58) Field of Classification Search
CPC ..... E04B 1/86; E04B 2001/8433; E04B 2001/8461; E04B 2001/8476;
(Continued)

(56) References Cited

U.S. PATENT DOCUMENTS 2,000,806 A * 5/1935 White ..... G10K 11/175 181/30
2,159,488 A * 5/1939 Parkinson ..... E04B 1/82 52/145

(Continued)

FOREIGN PATENT DOCUMENTS

JP 10-245823 A 9/1998
JP 2013-047858 A 3/2013
KR 10-2007-0004908 A 1/2007

OTHER PUBLICATIONS

Hyun-Sil Kim et al., Internoise 2017 Conference, Low frequency sound absorption of thin plates in a rigid duct, 11 Pages, Hong Kong, China on Aug. 27-30, 2017.

*Primary Examiner* — Jeremy A Luks
(74) *Attorney, Agent, or Firm* — Hauptman Ham, LLP

(57) ABSTRACT

A sound absorbing cell according to an exemplary embodiment of the present invention is formed of a plurality of plates that are stacked while interposing an air layer therebetween, wherein the plurality of plates include: a reflective plate that is disposed outermost from a space where sound is generated; and a microperforated plate that is stacked on the reflective plate and having a plurality of holes perforated therein.

11 Claims, 10 Drawing Sheets

C : C1 ~ C6

(51) Int. Cl.
*G10K 11/168* (2006.01)
*E04B 1/84* (2006.01)

(52) U.S. Cl.
CPC ..... *E04B 2001/8433* (2013.01); *E04B 2001/8461* (2013.01); *E04B 2001/8476* (2013.01); *E04B 2001/8485* (2013.01)

(58) Field of Classification Search
CPC . E04B 2001/8485; E04B 1/99; G10K 11/162; G10K 11/168
USPC ..... 181/286, 290, 293, 224
See application file for complete search history.

(56) References Cited

U.S. PATENT DOCUMENTS 2,177,393 A * 10/1939 Parkinson ..... E04B 1/82 52/145
6,290,022 B1 * 9/2001 Wolf ..... G10K 11/172 181/286
6,601,673 B2 * 8/2003 Murakami ..... F02B 77/13 181/204
7,520,369 B2 * 4/2009 Dravet ..... B64D 29/00 181/284
8,109,361 B2 * 2/2012 Tsugihashi ..... F04B 39/0027 181/207
8,499,887 B2 * 8/2013 Gleine ..... B60R 13/0815 181/292
8,931,588 B2 * 1/2015 Murray ..... F02C 7/045 181/214
8,955,643 B2 * 2/2015 Liu ..... F02C 7/045 181/213
2006/0131104 A1 * 6/2006 Yamaguchi ..... B60R 13/08 181/293
2006/0289229 A1 * 12/2006 Yamaguchi ..... G10K 11/172 181/290
2007/0272482 A1 * 11/2007 Yamaguchi ..... G10K 11/172 181/290
2008/0128200 A1 * 6/2008 Tsugihashi ..... B60R 13/0815 181/284
2008/0135327 A1 * 6/2008 Matsumura ..... G10K 11/172 181/151
2010/0175949 A1 * 7/2010 Yamaguchi ..... G10K 11/172 181/286

* cited by examiner

C : C1 ~ C6

SOUND ABSORBING CELL AND SOUND ABSORBING STRUCTURE HAVING THE SAME

CROSS-REFERENCE TO RELATED APPLICATION

This application claims priority to and the benefit of Korean Patent Application No. 10-2017-0117250 filed in the Korean Intellectual Property Office on Sep. 13, 2017, the entire contents of which are incorporated herein by reference.

BACKGROUND OF THE INVENTION

(a) Field of the Invention

The present invention relates to a sound absorbing cell and a sound absorbing structure including the same.

More particularly, it relates to a sound absorbing cell that can absorb sound in a wide frequency band, and a sound absorbing structure including the same.

(b) Description of the Related Art

A sound absorbing board is used in various fields such as a lecture hall, a performance hall, industry, public transportation, and the like because it serves to mitigate noises.

A conventional sound absorbing board is manufactured by using a porous fiber material, or a Helmholtz resonator. The Helmholtz resonator has a limitation in which it provides a sound absorbing effect only for a specific frequency, more complicated resonator structure is needed and the size thereof needs to be large. Also, the sound absorbing board made of a porous material needs to be thick to absorb sound in a low frequency band.

Further, the conventional sound absorbing board made of a porous material is weak to humidity and has a poor durability, and it is not environmental-friendly because there is possibility of generating toxic gas in case of fire.

The above information disclosed in this Background section is only for enhancement of understanding of the background of the invention and therefore it may contain information that does not form the prior art that is already known in this country to a person of ordinary skill in the art.

SUMMARY OF THE INVENTION

One aspect of the present invention is to provide a sound absorbing cell that can absorb sound in a wide frequency band.

Another aspect of the present invention is to provide a sound absorbing structure that can absorb sound in a wide frequency band, and can be easily optimum-designed according to a targeted sound absorbing frequency band.

A sound absorbing cell according to an exemplary embodiment of the present invention is formed of a plurality of plates that are stacked while interposing an air layer therebetween, wherein the plurality of plates include: a reflective plate that is disposed outermost from a space where sound is generated; and a microperforated plate that is stacked on the reflective plate and having a plurality of holes perforated therein.

The plurality of plates may further include an elastic plate that is stacked on the reflective plate or the microperforated plate.

The microperforated plate may be rigid or elastic.

Each of the elastic plate and the microperforated plate may have a thickness of 1 mm or less.

A diameter of each hole perforated in the microperforated plate may be 1 mm or less.

A perforation ratio of the microperforated plate may be 1% or less.

At least one of the microperforated plate and the elastic plate may be provided in plural.

The elastic plate may include a plurality of elastic plates, each having a different thickness.

The microperforated plate may include a plurality of microperforated plates, each having a different thickness.

The microperforated plate may include a plurality of microperforated plates, each having a different perforation ratio.

According to an exemplary embodiment, a sound absorbing structure is provided. In the sound absorbing structure, the above-described sound absorbing cell are provided in plural and arranged adjacent to each other on a plane, and the plurality of sound absorbing cells may respectively have different sound absorbing frequency bands.

At least some of the plurality of sound absorbing cells may have different numbers of plates.

At least some of the plurality of sound absorbing cells may have different thicknesses.

The plurality of sound absorbing cells may have different areas, and a frequency band in which the sound absorbing structure can absorb sound may be adjusted depending on an area ratio of the plurality of sound absorbing cells.

When viewed from a front, each of the plurality of sound absorbing cells may have a rectangular shape, and the plurality of sound absorbing cells may be arranged while contacting a side of the quadrangle between neighboring sound absorbing cells.

A frame may be provided at an outer edge of the sound absorbing structure and a barrier rib may be provided between neighboring sound absorbing cells.

According to the exemplary embodiment of the present invention, a plurality of sound absorbing cells, each having a different sound absorbing frequency band, are arranged such that sound of a wide frequency band can be absorbed.

Further, optimal design is possible according to a targeted sound absorbing frequency band, and a high sound absorption effect can be provided in a high frequency band.

DETAILED DESCRIPTION OF THE EMBODIMENTS

Figure 1:
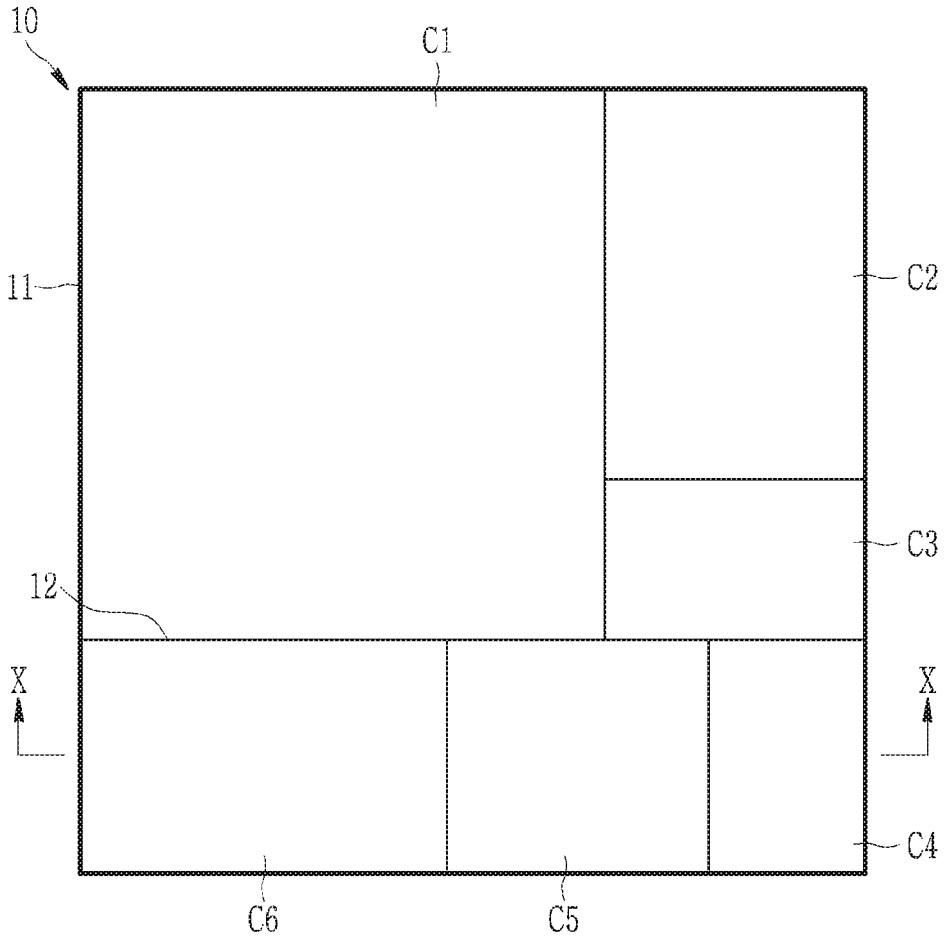
FIG. 1 is a front view of a sound absorbing structure according to an exemplary embodiment of the present invention.

Hereinafter, the present invention will be described more fully with reference to the accompanying drawings, in which exemplary embodiments of the invention are shown. As those skilled in the art would realize, the described embodiments may be modified in various different ways, all without departing from the spirit or scope of the present invention.

The drawings and description are to be regarded as illustrative in nature and not restrictive. Like reference numerals designate like elements throughout the specification.

Throughout the present specification, when any one part is referred to as being "connected to" another part, it means that the one part and the other part are "directly connected to" each other or are "indirectly connected to" each other with another part interposed therebetween. In addition, unless explicitly described to the contrary, the word "comprise" and variations such as "comprises" or "comprising" will be understood to imply the inclusion of stated elements but not the exclusion of any other elements.

Further, "~on" means a position above or below an objective member, but not a position necessarily above the objective member with reference to a gravity direction. Further, it does not mean just above the objective member, and also includes a position where another member is interposed.

Figure 2:
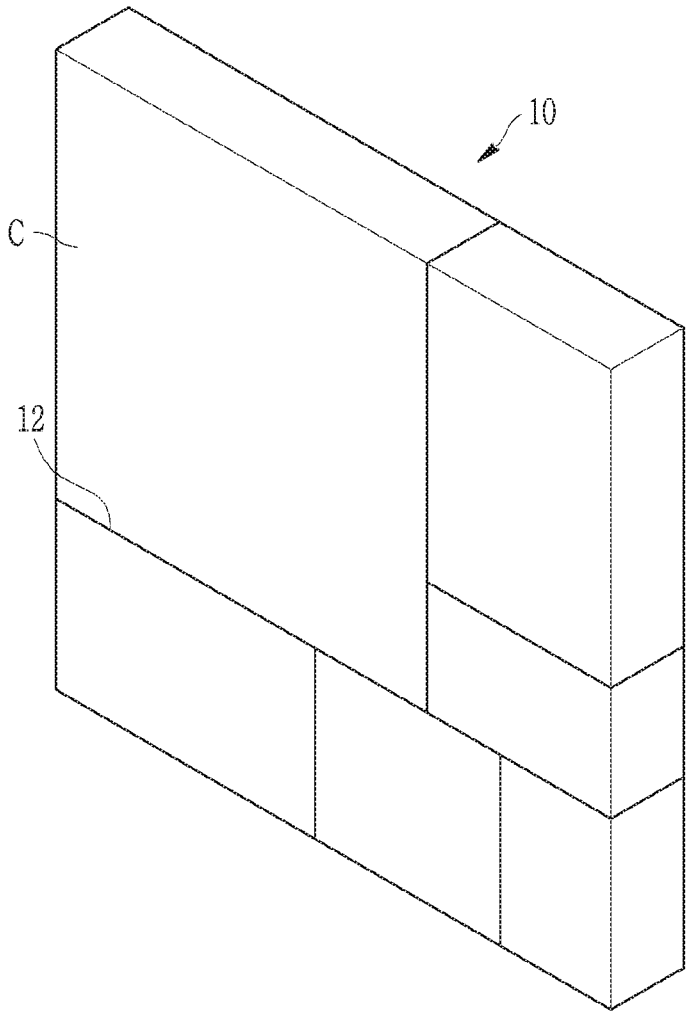
FIG. 2 is a perspective view of the sound absorbing structure according to the exemplary embodiment of the present invention.

FIG. 1 is a front view of a sound absorbing structure according to an exemplary embodiment of the present invention, and FIG. 2 is a perspective view of the sound absorbing structure according to the exemplary embodiment of the present invention.

Referring to FIG. 1 and FIG. 2, a sound absorbing structure 10 according to an exemplary embodiment of the present invention is formed of a plurality of sound absorbing cells C that are arranged to be adjacent to each other on a plane. In this case, each sound absorbing cell C may include a structure that can absorb a sound in a specific frequency band, and this will be described in details later.

Each of the plurality of sound absorbing cells C that form the sound absorbing structure 10 may be able to absorb a different frequency band, and accordingly, the sound absorbing structure can be easily designed according to a targeted sound absorbing frequency band by combining a plurality of sound absorbing cells, each having a different sound absorbing frequency.

For example, sound absorbing cells C1 to C6 may have different structures to absorb different sound absorbing frequency bands, and the sound absorbing structure 10, which is a combination of the sound absorbing cells C1 to C6, may form a single integrated structure. In FIG. 1 and FIG. 2, the sound absorbing structure 10 includes six sound absorbing cells C1 to C6, but this is not restrictive. Two or more sound absorbing cells C may form the sound absorbing structure 10.

Referring to FIG. 1, the plurality of sound absorbing cells C may have different areas when being viewed from the front. In this case, a frequency bandwidth in which the sound absorbing structure 10 can absorb a sound can be adjusted depending on an area ratio of the plurality of sound absorbing cells C. For example, when each of the plurality of sound absorbing cells C1 to C6 has a different sound absorbing frequency bandwidth, a sound absorbing cell that is closest to a target sound absorbing frequency band of the sound absorbing structure 10 is set to have the largest area and an area of a sound absorbing cell is set to be smaller as a difference from the target sound absorbing frequency bandwidth is increased, such that the plurality of sound absorbing cells C1 to C6 can be designed to be appropriate for the target sound absorbing frequency band of the sound absorbing structure 10.

Referring to FIG. 1 and FIG. 2, each sound absorbing cell C may have a rectangular shape when being viewed at the front, and adjacent sound absorbing cells may be arranged while contacting the four sides of the rectangular sound absorbing cell. For example, each sound absorbing cell C may be entirely formed in the shape of a cuboid or a rectangular column. Accordingly, the sound absorbing structure 10 may be integrally formed by the plurality of sound absorbing cells C that are arranged adjacent to each other, and for example, the sound absorbing structure 10 may be entirely rectangular in shape when viewed from the front, or may be formed in the shape of a board having a predetermined thickness. However, the shape of the sound absorbing cell C and the sound absorbing structure 10 are not limited thereto, and they may have various shapes.

A frame 11 may be provided at an outer edge of the sound absorbing structure 10, and a barrier rib 12 is provided between adjacent sound absorbing cells C such that the sound absorbing structure 10 can maintain the overall shape and rigidity and the plurality of sound absorbing cells C can be partitioned in such a way so as to independently maintain sound absorbing frequencies between the plurality of sound absorbing cells C.

In FIG. 2, the frame 11 of the sound absorbing structure 10 is omitted for convenience of description.

Hereinafter, a configuration in which the plurality of sound absorbing cells C that form the above-stated sound absorbing structure 10 respectively have different sound absorbing frequencies will be described.

Figure 3:
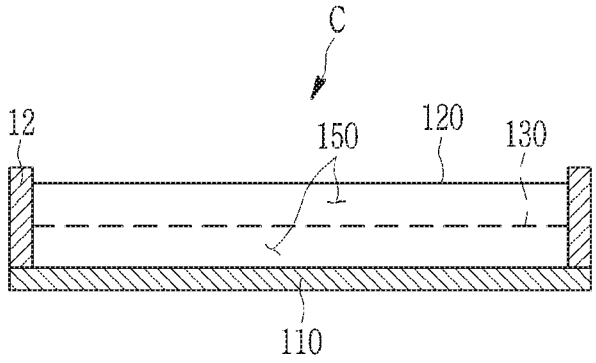
FIG. 3 is a cross-sectional view of the sound absorbing cell according to the exemplary embodiment of the present invention.

FIG. 3 is a cross-sectional view of a sound absorbing cell according to the exemplary embodiment of the present invention.

Referring to FIG. 3, the sound absorbing cell C has a structure in which a plurality of plates are stacked. The plurality of plates are stacked while interposing air layers 150 therebetween such that the plurality of plates are stacked in parallel with each other while being apart from each other with a predetermined gap therebetween. Here, the plurality of plates may be made of a metal, for example, steel or aluminum. However, this is not restrictive, and various materials such as a metal alloy, a synthetic resin, and the like may be used.

According to the exemplary embodiment of the present invention, the plurality of plates that form the sound absorbing cell C include a reflective plate 110 and a microperforated plate 130. The reflective plate 110 is disposed outermost from a space where sound is generated, and the microperforated plate 130 is stacked on the reflective plate 110 and has a plurality of holes formed therein.

The reflective plate 110 is a portion that reflects a sound wave coming into the sound absorbing cell C, and may be formed of a rigid body having a predetermined thickness. For example, the rigid body may be formed of a rigid block or a rigid wall. The reflective plate 110 may be disposed at the farthest position from where the sound is generated. That is, the reflective plate 110 may be disposed at the outermost plate among the plurality of plates that form the sound absorbing cell C.

The microperforated plate 130 serves to absorb sound, and may be disposed on the reflective plate 110, interposing the air layer 150 therebetween. The plurality of holes (micro-perforations) are formed in the microperforated plate 130 having a thickness of less than 1 mm, and absorb sound by using the principle that a sound occurs due to air friction in the hole. In this case, since the air layer 150 exists behind the microperforated plate 130 with reference to a direction along which a sound wave moves, the microperforated plate 130 may serve a function that is similar to the mechanism of a Helmholtz resonator. However, since the microperforated plate 130 has micro-perforations, sound can be absorbed in a wide bandwidth compared to the Helmholtz resonator that absorbs sound only at a specific frequency.

According to the exemplary embodiment of the present invention, each hole formed in the microperforated plate 130 may have a diameter of less than 1 mm. In case of such a microperforated plate, experimentally, sound absorption may be more effective as the hole diameter is smaller. However, it is difficult for the microperforated plate 130 to be processed to have a diameter of less than 1 mm due to difficulty in fabrication, and it can sufficiently absorb sound by a material to be described later and an elastic plate to be added.

According to the exemplary embodiment of the present invention, a perforation ratio of the microperforated plate 130 may be 1% or less. The perforation ratio implies a ratio of holes with respect to the entire area, and as the perforation ratio of the microperforated plate 130 is experimentally increased to some degree or more, the sound absorption effect is deteriorated, and therefore the perforation ratio of the microperforated plate 130 is set to be 1% or less to increase the sound absorption effect while expanding a sound absorption frequency band.

Figure 4:
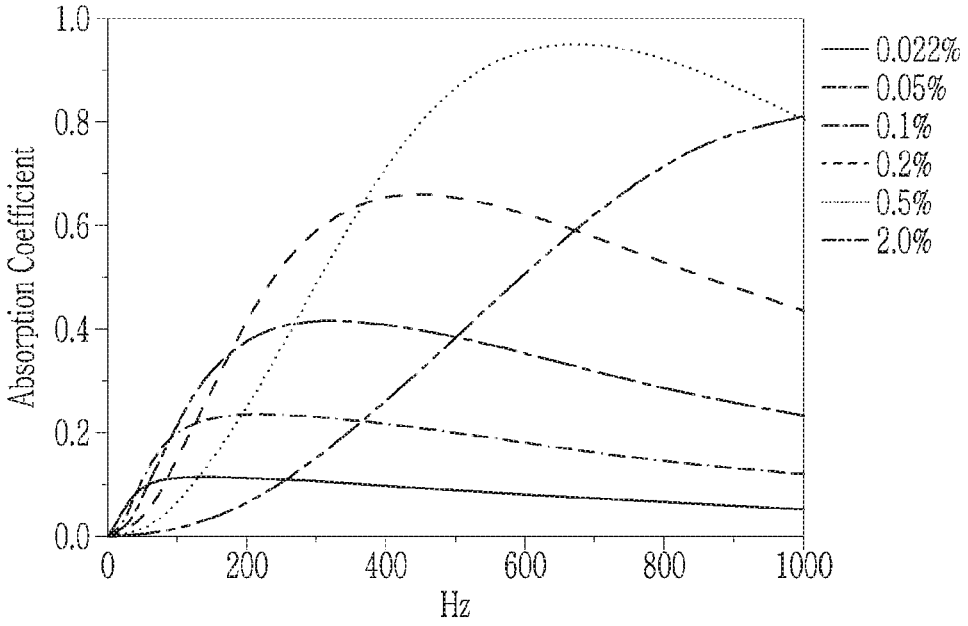
FIG. 4 is a graph that shows a sound absorbing effect of a microperforated plate according to a perforation rate.

FIG. 4 is a graph that shows a sound absorption effect of the microperforated plate according to the perforation ratio. The graph of FIG. 4 shows a result of an experiment on a sound absorption effect according to a frequency in a case that a microperforated plate made of a rigid body is disposed in a vent tube having a shape of a rectangular column while having a gap (i.e., a thickness of an air layer) of 60 mm with a reflective plate that is disposed behind the microperforated plate, and a perforation ratio of the microperforated plate is changed within a range of 0.022% to 2.0%. The perforation ratios of the microperforated plate are shown at the top right side of the graph of FIG. 4. Referring to FIG. 4, the sound absorption efficiency is decreased and a sound absorption frequency is narrowed when the perforation ratio of the microperforated plate is greater than 1%.

Meanwhile, as shown in FIG. 4, the microperforated plate made of a rigid body may have a relatively wide sound absorbing frequency band, but cannot provide a high sound absorbing effect (indicated by the absorption coefficient in the y-axis). Thus, in order to achieve higher sound absorption efficiency while having a wideband of a sound absorption frequency, the sound absorbing cell C according to the exemplary embodiment of the present invention may further include an elastic plate 120 (refer to FIG. 3).

The elastic plate 120 is a thin elastic plate having a thickness of 1 mm or less. As shown in FIG. 3, the elastic plate 120 may be disposed on the microperforated plate 130, interposing the air layer 150 therebetween, or, although it is not illustrated, it may be disposed on the reflective plate 110, interposing the air layer 150 therebetween, and another microperforated plate 130 may be disposed on the elastic plate 120, interposing an air layer 150 therebetween.

The elastic plate 120 can absorb sound by changing a wavelength due to elasticity, and the sound absorption effect may be changed depending on a plate thickness, a material of the plate, and a gap with the air layer disposed therebehind, but it can be experimentally observed that an absorption coefficient is high at a resonance frequency of the elastic plate 120.

Figure 5:
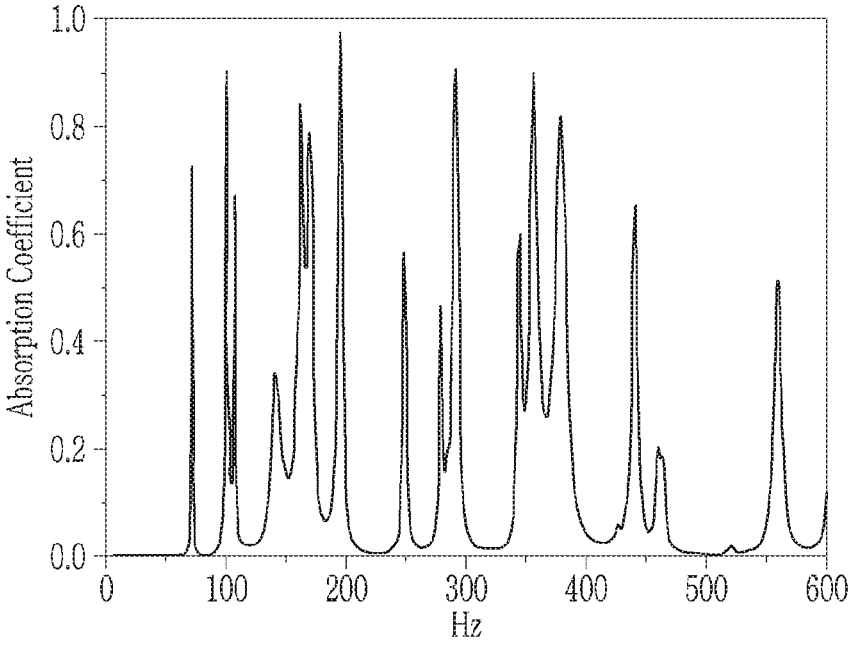
FIG. 5 is a graph that shows a sound absorbing effect of an elastic plate.

FIG. 5 is a graph that shows the sound absorption effect of the elastic plate. The graph of FIG. 5 shows an experiment result of a sound absorption effect according to a frequency in a case that two elastic plates, respectively having a thickness of 0.2 mm and a thickness of 0.3 mm, are disposed in a duct having a rectangular cross-section and then an air layer having a thickness of 30 mm (i.e., a gap between the elastic plates and a gap between an external elastic plate and a reflective plate) is formed behind the two elastic plates. Referring to FIG. 5, the elastic plate 120 has a high sound absorption effect at a specific frequency (i.e., a resonance frequency) but the sound absorption effect is deteriorated at other frequencies, and accordingly it can be observed that the elastic plate 120 does not have a wide sound absorbing frequency band.

Thus, according to the exemplary embodiment of the present invention, the microperforated plate 130 and the elastic plate 120 are arranged together, so that the disadvantage that the elastic plate 120 has a limited range of sound absorption frequencies can be overcome. That is, the sound absorbing cell C according to the exemplary embodiment of the present invention has a feature of a wideband sound absorbing frequency of the microperforated plate 130 and a high sound absorption effect of the elastic plate 120.

Meanwhile, according to the exemplary embodiment of the present invention, one of the microperforated plate 130 and the elastic plate 120 may be provided in plural. That is, as described above, since the sound absorbing cell C is formed by combining the microperforated plate 130 and the elastic plate 120, the sound absorbing cell C has both of the feature of the microperforated plate 130 and the feature of the elastic plate 120. Thus, a sound absorbing cell C having a targeted sound absorbing frequency and a targeted sound absorption coefficient can be easily designed by arranging a plurality of microperforated plates 130 and an elastic plate 120 in various manners. In addition, since the plurality of microperforated plates 130 or the plurality of elastic plates 120 are arranged, a feature of each plate may be overlapped, and accordingly, a sound absorption feature or a wideband characteristic of a sound absorbing frequency can be optimized.

Figure 6:
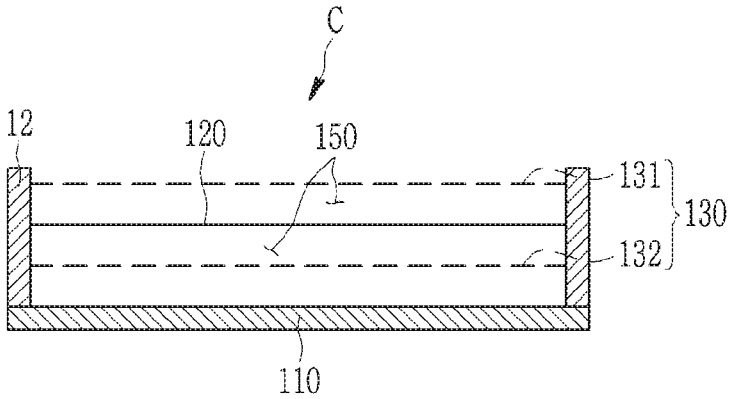
FIG. 6 and FIG. 7 are cross-sectional views of various shapes of the sound absorbing cell.
Figure 7:
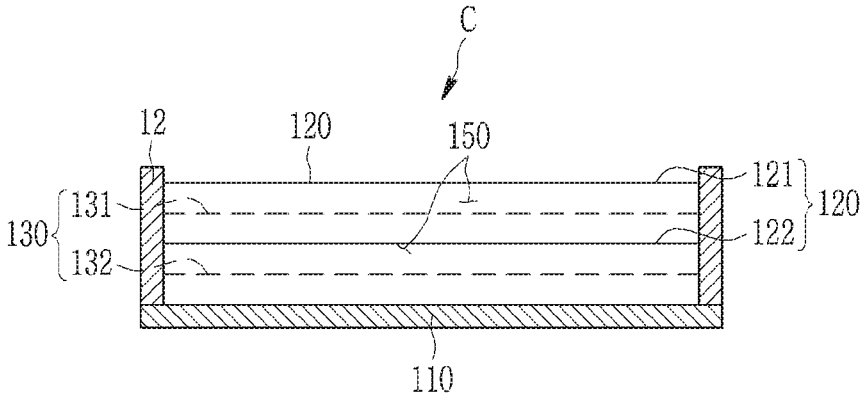

FIG. 6 and FIG. 7 are cross-sectional views of various shapes of the sound absorbing cell. Referring to FIG. 6 and FIG. 7, the microperforated plate 130 and the elastic plate 120 may be provided in various numbers and may be stacked in various orders. In addition, referring to FIG. 6, the microperforated plate 130 may include a first microperforated plate 131 and a second microperforated plate 132, each having a different thickness, and referring to FIG. 7, the elastic plate 120 may include a first elastic plate 121 and a second elastic plate 122, each having a different thickness. However, various structures of the sound absorbing cell C shown in FIG. 6 and FIG. 7 are exemplarily provided, and the sound absorbing cell C can be modified with more various structures. For example, the microperforated plate 130 may be provided singularly and the elastic plate 120 may be provided in plural, or vice versa. The plurality of microperforated plates 130 or the plurality of elastic plates 120 may have the same thickness, some of them may have the same thickness, or they all may have different thicknesses. The plurality of microperforated plates 130 may respectively have the same perforation ratio, some of them may have the same perforation ratio, or they all may have different perforation ratios. The plurality of elastic plates 120 may be formed of the same material, some of them may be formed of the same material, or they all may be formed of different materials, respectively. The sound-absorbing cell C may have a variety of structures that can be easily changed by a person skilled in the art.

Meanwhile, according to the exemplary embodiment of the present invention, the microperforated plate 130 may be provided as a plate having elasticity. As previously described, when the microperforated plate 130 is provided as a general rigid body, the microperforated plate 130 may not have a high sound absorbing effect, and thus micro perforations are formed in an elastic plate having elasticity to combine a wideband sound absorbing characteristic of the microperforated plate 130 and the high sound absorbing effect of the elastic plate.

Figure 8:
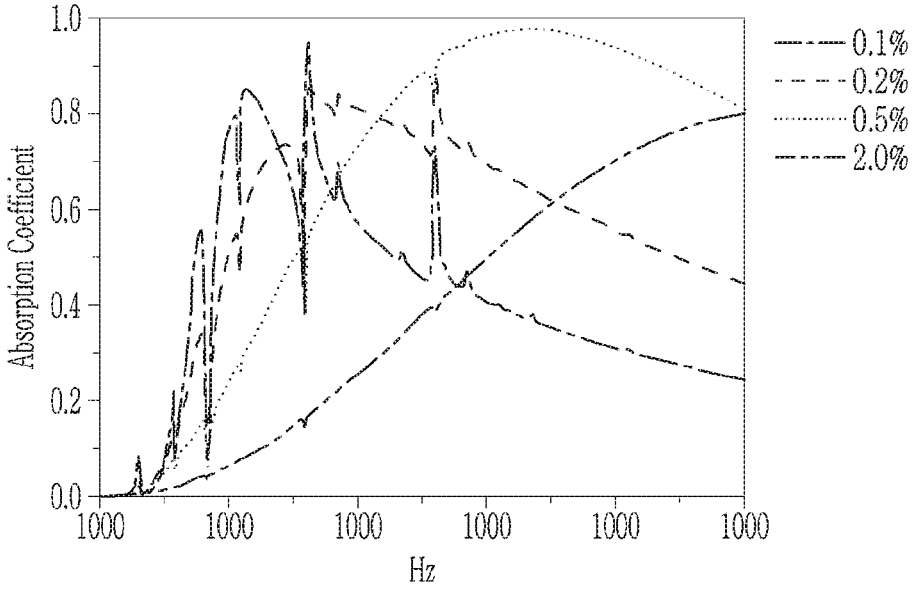
FIG. 8 is a graph that shows a sound absorbing effect of an elastic microperforated plate.

FIG. 8 is a graph that shows a sound absorbing effect of the microperforated plate having elasticity. The graph of FIG. 8 shows a numerical simulation result of a sound absorbing effect according to a frequency in the case that a microperforated plate having elasticity is disposed in a duct having a rectangular cross-section with a gap of 600 mm behind the microperforated plate. During the simulation, a perforation ratio of the microperforated plate is changed within a range of 0.1% to 2.0%. The perforation ratios of the microperforated plate are shown at the top right side of the graph. Referring to FIG. 8, the microperforated plate having elasticity has an overlap of the wideband sound absorbing characteristics of the rigid body microperforated plate and high sound absorbing characteristics of the elastic plate. That is, it can be observed that a tendency of overlapping between FIG. 4 and FIG. 5 appears. Further, an influence with respect to a peroration ratio can be observed. When the perforation ratio exceeds 1%, the wideband sound absorption and high sound absorbing effect may both be deteriorated.

Figure 9:
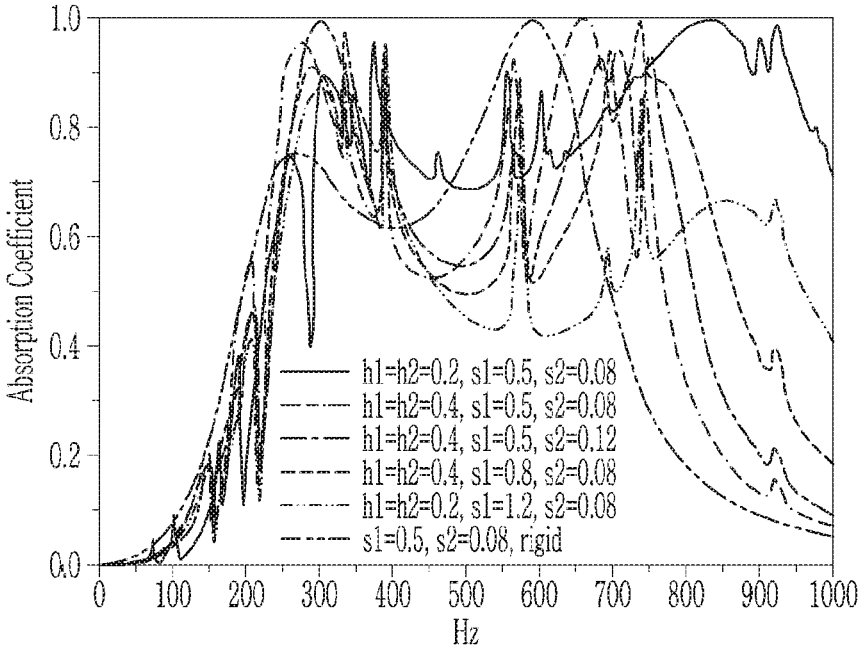
FIG. 9 is a graph that shows a sound absorbing effect of a plurality of microperforated plates, each having elasticity.

FIG. 9 is a graph that shows a sound absorbing effect of a plurality of microperforated plates having elasticity. The graph of FIG. 9 shows a numerical simulation result of a sound absorbing effect in a case that two microperforated plates having elasticity are disposed in a duct having a rectangular cross-section, while having an air layer (a gap between two microperforated plates and a gap between an outer microperforated plate and a reflective plate) with a thickness of 30 mm disposed therebehind, and perforation ratios of each of the two microperforated plates set to be different from each other, while changing the perforation ratios within a range of 0.08% to 1.2%. The lower center of the graph of FIG. 9 indicates thicknesses h1 and h2 of the microperforated plate and perforation ratios s1 and s2 of the microperforated plate, and a case that the two microperforated plates are rigid is also shown for comparison. Referring to FIG. 9, it can be observed that the microperforated plate having elasticity has a high sound absorbing characteristics of the elastic plate and a wide band sound absorbing frequency characteristics of the rigid microperforated plate, and, compared to FIG. 8, the wide sound absorbing frequency and high sound absorption effect can be amplified by arranging a plurality of elastic microperforated plates. Further, an influence with respect to the perforation ratio can be observed, and when the perforation ratio exceeds 1%, both the wide band sound absorption and the high sound absorbing effect are deteriorated.

As described above, the sound absorbing cell C according to the exemplary embodiment of the present invention is formed by arranging at least one microperforated plate and at least one elastic plate, interposing the air layer therebetween with various numbers and various orders so that the wide band sound absorbing characteristic of the microperforated plate and the high sound absorbing characteristic of the elastic plate can be overlapped. In addition, since the microperforated plate is made of an elastic material, the wide band sound absorbing characteristic of the microperforated plate and the high sound absorbing characteristic of the elastic plate can be overlapped.

A sound absorbing structure 10 that is variously modified based on various structures of the above-stated sound absorbing cell C will now be exemplarily described.

Figure 10:
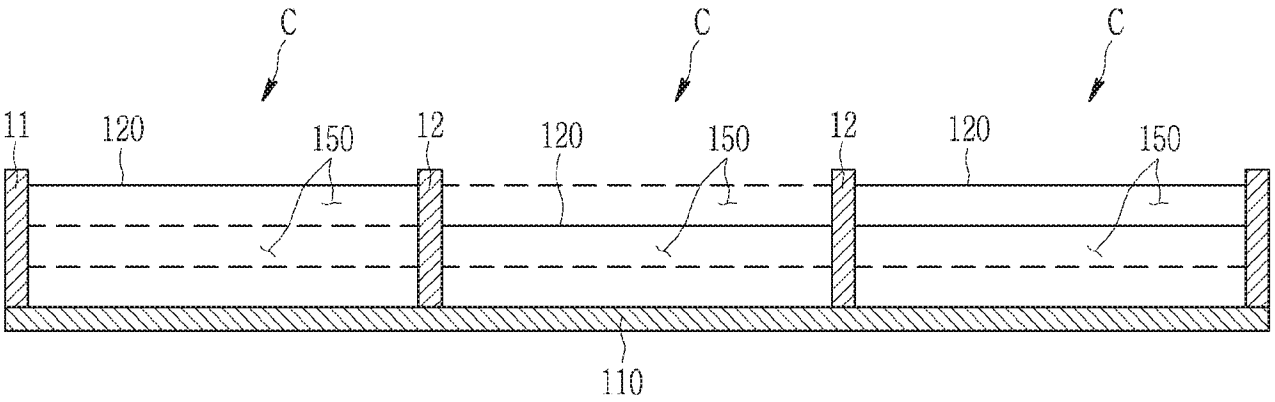
FIG. 10 is a cross-sectional view of FIG. 1 along a line X-X.
Figure 11:
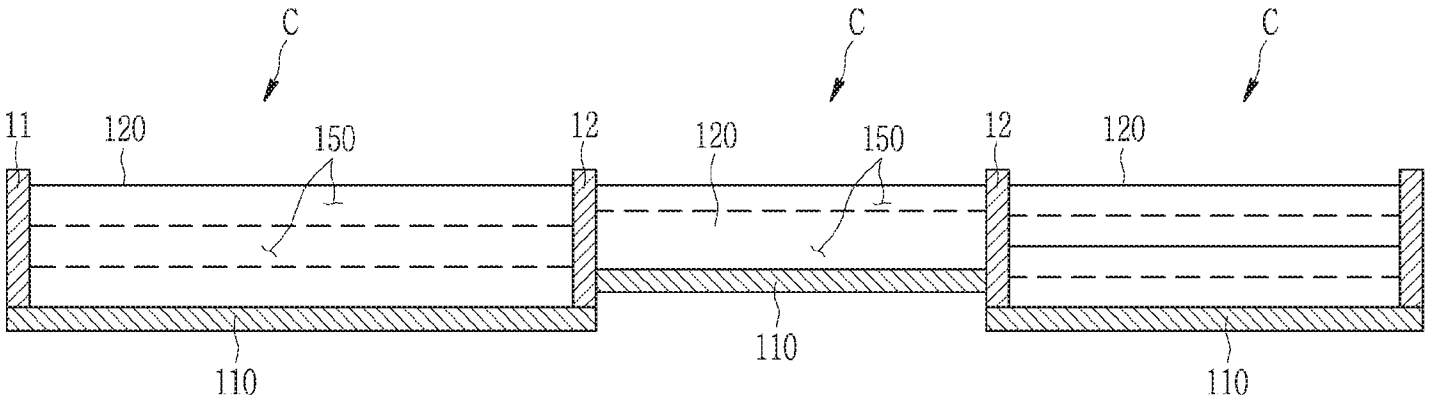
FIG. 11 and FIG. 12 show other forms of FIG. 10.
Figure 12:
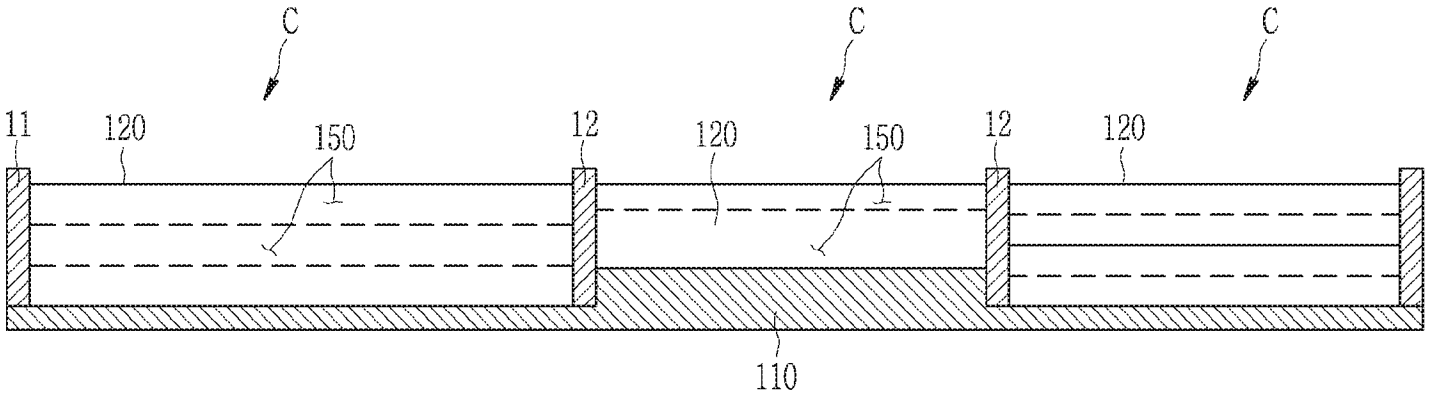

FIG. 10 is a cross-sectional view of FIG. 1, taken along the line X-X, and FIG. 11 and FIG. 12 show other forms of FIG. 10.

Referring to FIG. 10, a sound absorbing structure 10 according to an exemplary embodiment of the present invention includes a barrier rib 12 that partitions sound absorbing cells C that are adjacent to each other such that the sound absorbing cells C can be independently partitioned, and a frame 11 is provided at an outer edge of the sound absorbing structure 10 to maintain the shape of the sound absorbing structure 10. Each sound absorbing cell C may have a different sound absorbing frequency band since the microperforated plate 130 can be provided in various numbers, various arrangements, and various thicknesses. In this case, each sound absorbing cell C may have the same thickness. In such a case, as shown in FIG. 2, the sound absorbing structure 10 may have a rectangular shape or a board shape having a predetermined thickness.

Referring to FIG. 11, in a sound absorbing structure 10 having another shape of the present invention, at least some of a plurality of sound absorbing cells C may have different thicknesses. As previously described, the number of elastic plates 120 and the number of microperforated plates 130 that form each of the sound absorbing cells C and a gap with an air layer 150 may be variously changed. In such a case, unlike the sound absorbing structure 10 of FIG. 2, one side of the sound absorbing structure 10 may not be flat.

Referring to FIG. 12, in a sound absorbing structure 10 having another shape of the present invention, at least some of a plurality of sound absorbing cells C may have different thicknesses, except for a reflective plate 110. In this case, the plurality of sound absorbing cells C may be set to have the same thickness by adjusting the thickness of the reflective plate 110. In this case, the reflective plate 110 may be integrally formed to be shared by one or more sound absorbing cells.

As described, since the sound absorbing structure 10 can be modified with various shapes, the sound absorbing structure 10 can be easily designed according to the place and the conditions where it is installed. Meanwhile, the sound absorbing structures 10 described with reference to FIG. 11 and FIG. 12 are described as examples of the modified shapes of the sound absorbing structure 10, and therefore the present invention is not limited thereto. The present invention can be variously modified by those skilled in the art.

As described above, the sound absorbing structure 10 according to the exemplary embodiment of the present invention can absorb sound in a wide frequency range by arranging a plurality of sound absorbing cells, each having a different sound absorbing frequency band, and the sound absorbing structure 10 can be easily designed according to a targeted sound absorbing frequency band and may have a high sound absorbing effect in a wide frequency band. Accordingly, sound of a low frequency band can be absorbed through a thin sound absorbing structure 10.

In addition, since a metal material is used, the sound absorbing structure can be strong against humidity and can be durable, and the sound absorbing structure 10 has an additional advantage of being environmental-friendly because there is no possibility of generating toxic gas in case of fire.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

DESCRIPTION OF SYMBOLS

| | |
|---|---|
| 10 sound absorbing structure | 11 frame |
| 12 barrier rib | 110 reflective plate |
| 120 elastic plate | 130 microperforated plate |
| 150 air layer | C sound absorbing cell |

What is claimed is:

1. A sound absorbing cell formed of a plurality of plates that are stacked while interposing an air layer therebetween, wherein the plurality of plates comprise:

a reflective plate disposed outermost from a space where sound is generated;

a first microperforated plate stacked on the reflective plate and having a first plurality of holes perforated therein;

a first elastic plate stacked on the first microperforated plate;

a second microperforated plate stacked on the first elastic plate and having a second plurality of holes perforated therein; and a second elastic plate stacked on the second microperforated plate, wherein the first and second elastic plates have a different thickness from each other, wherein the first and second microperforated plates have a different thickness from each other, and wherein the first and second microperforated plates have a different perforation ratio from each other.

2. The sound absorbing cell of claim 1, wherein the first and second microperforated plates are elastic.

3. The sound absorbing cell of claim 1, wherein each of the first elastic plate, second elastic plate, first microperforated plate, and second microperforated plate has a thickness of 1 mm or less.

4. The sound absorbing cell of claim 1, wherein a diameter of each hole of the plurality of holes perforated in the first and second microperforated plates is 1 mm or less.

5. The sound absorbing cell of claim 1, wherein perforation ratios of the first and second microperforated plates are 1% or less.

6. A sound absorbing structure comprises:

a plurality of sub-cells; and a plurality of barrier ribs provided between adjacent sub-cells of the plurality of sub-cells to partition off the plurality of sub-cells from the sound absorbing structure, wherein each of the plurality of sub-cells is formed of a plurality of plates that are stacked while interposing an air layer therebetween, and wherein the plurality of plates comprise:

a reflective plate disposed outermost from a space where sound is generated;

a first microperforated plate stacked on the reflective plate and having a first plurality of holes perforated therein;

a first elastic plate stacked on the first microperforated plate;

a second microperforated plate stacked on the first elastic plate and having a second plurality of holes perforated therein; and a second elastic plate stacked on the second microperforated plate, wherein the first and second elastic plates have a different thickness from each other, wherein the first and second microperforated plates have a different thickness from each other, wherein the first and second microperforated plates have a different perforation ratio from each other, and wherein the plurality of sub-cells have a different sound absorbing frequency band from each other.

7. The sound absorbing structure of claim 6, wherein at least one sub-cell of the plurality of sub-cells comprises different numbers of plates from the other sub-cells of the plurality of sub-cells.

8. The sound absorbing structure of claim 6, wherein at least one sub-cell of the plurality of sub-cells has a different thickness of the one sub-cell from the other sub-cells of the plurality of sub-cells.

9. The sound absorbing structure of claim 6, wherein at least one sub-cell of the plurality of sub-cells has different area size from the other sub-cells of the plurality of sub-cells.

10. The sound absorbing structure of claim 6, wherein when viewed from a front, each of the sub-cells has a rectangular shape, and the plurality of sub-cells are arranged while contacting a side of the rectangular shape between neighboring sub-cells.

11. The sound absorbing structure of claim 6, further comprises:

a frame provided at an outer edge of the sound absorbing cell, wherein the plurality of barrier ribs is provided between neighboring sound absorbing cells in the frame.

* * * * *